United States Patent [19]

Robbins et al.

[11] Patent Number: 4,979,914

[45] Date of Patent: Dec. 25, 1990

[54] EXTENDER BOARD CONNECTOR

[75] Inventors: Dan E. Robbins, Glendale; Joseph F. Straceski, Phoenix, both of Ariz.

[73] Assignee: Honeywell Inc., Minneapolis,, Minn.

[21] Appl. No.: 425,097

[22] Filed: Oct. 23, 1989

[51] Int. Cl.[5] ..... H01R 13/64

[52] U.S. Cl. ..... 439/681; 439/680

[58] Field of Search ..... 439/59, 61, 62, 64, 439/633, 677, 678, 679, 680, 681

[56] References Cited

U.S. PATENT DOCUMENTS

| | | | |
|---|---|---|---|
| 2,952,810 | 9/1960 | Helton | 439/61 X |
| 3,177,461 | 4/1965 | Hagan et al. | 439/633 |
| 3,404,362 | 10/1968 | Amendola | 439/681 X |
| 3,714,617 | 1/1973 | Bright et al. | 439/681 |
| 3,958,858 | 5/1976 | Silveira, Jr. | 439/633 |
| 4,109,987 | 8/1978 | Bouroon | 439/680 X |
| 4,181,391 | 1/1980 | Kilsdonk | 439/679 X |
| 4,568,134 | 2/1986 | Dimondi | 439/680 X |

*Primary Examiner*—Neil Abrams
*Assistant Examiner*—Khiem Nguyen
*Attorney, Agent, or Firm*—Howard Paul Terry

[57] ABSTRACT

An extender board connector is provided for connecting a circuit board card to a motherboard through an extender card for routing signals from the motherboard to the top of the extender for testing the circuit board card. The connector has first and second end portions, each having an integral mounting block with an octogonal slot. The connector also has first and second pins, each having an enlarged end portion and an octogonal middle portion and a grooved end portion with a ring groove. The octogonal middle portion of the pin is received in the octogonal slot of the connector for providing eight positions at each connector or a combination of eight-squared positions or 64 positions. The pin has a snap-on retaining ring received in the pin groove, and has a ring spacer disposed next to the snap-on retaining ring, and has a helical compression spring disposed between the ring spacer and the mounting block. The pin is adjustable for keying to one of eight positions by compressing the spring by pressing the spring on the grooved end portion and by then rotating the pin to the desired position.

5 Claims, 1 Drawing Sheet

10
12
14
16
18
20
22

18
30
36
46
34
16
48
32
50
24

6
6
31
38
36
30
34
32

26
30
16

30
31

18
3
3
26
28
30
40
46
32
42
44
4
4
16
12

EXTENDER BOARD CONNECTOR

The invention relates to an extender board connector, and in particular the invention relates to an extender board connector having an adjustable fastener pin.

BACKGROUND OF THE INVENTION

The prior art extender board connector had a pair of fastener pins which were set at respective fixed angles to suit the position of an extender board and the position of a circuit board card.

The function of the extender board is to troubleshoot a circuit board card while it is electrically connected to a motherboard. The extender board connector routes signals from the circuit board card to the top of the extender board for testing.

One problem with the prior art extender board connector is that a separate connector is required for each uniquely positioned circuit board card.

SUMMARY OF THE INVENTION

According to the present invention, an extender board connector is provided. This connector comprises a first elongate end portion, and a second elongate end portion similar to, but opposite hand to the first elongate end portion, said first and second end portions having first and second multi-sided holes; and first and second fasteners having respective first and second pins having respective first and second pin portions having respective first and second multi-sided outer surfaces being respectively received in said first and second multi-sided holes.

By using multi-sided holes in the connector end portions and multi-sided outer surfaces in the fastener pins, the problem of needing a separate connector for each uniquely positioned circuit board card is avoided.

The foregoing and other objects, features and advantages will be apparent from the following description of the preferred embodiment of the invention as illustrtated in the accompanying drawings.

DESCRIPTION OF THE PREFERRED EMBODIMENT

Figures 1, 2, 3, 4, 5, 6:
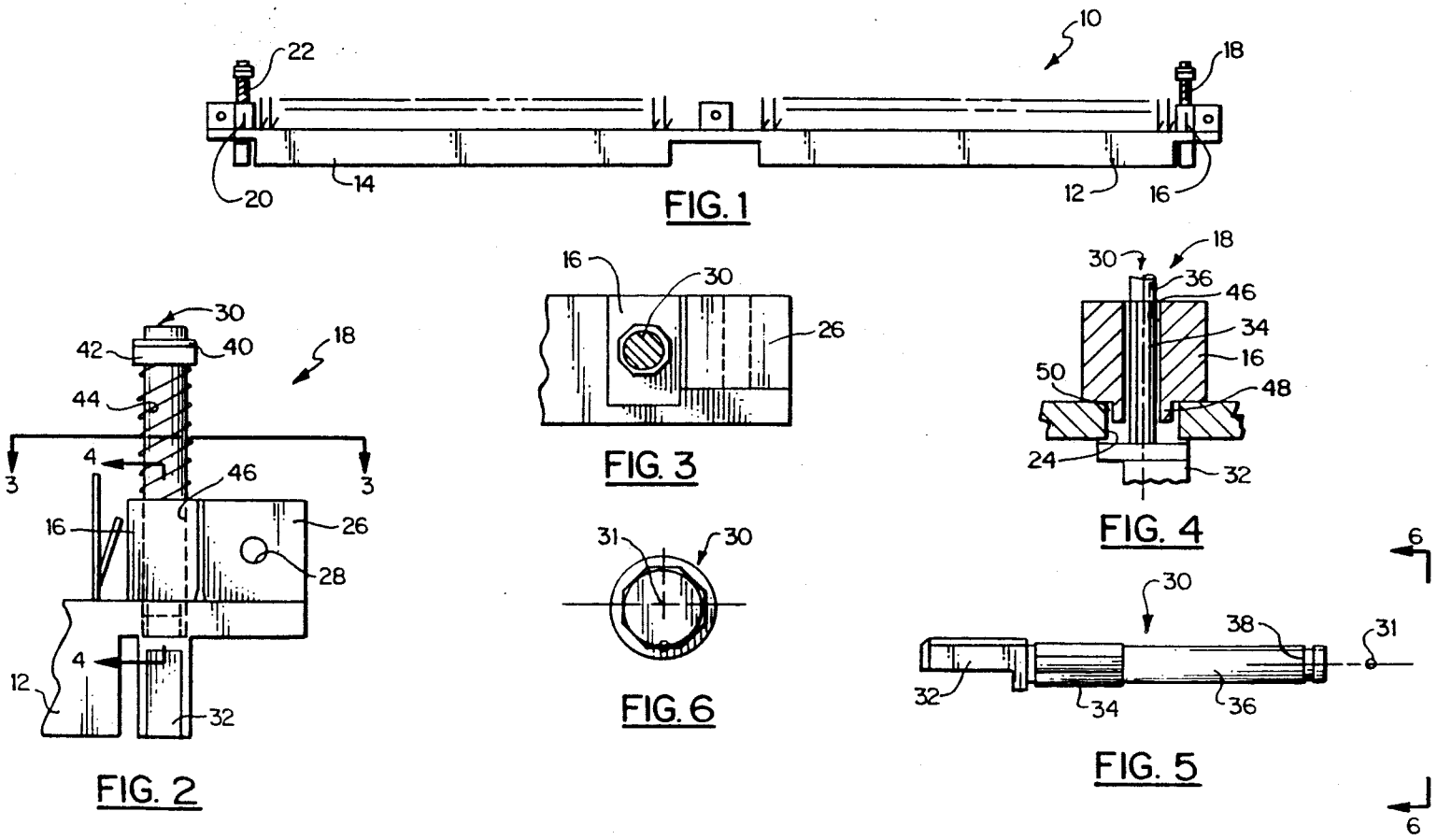
FIG. 1 is a plan view of a connector according to the present invention.
Fig. 2 is an enlarged view of a portion of FIG. 1.
FIG. 3 is a section view as taken along the line 3—3 of FIG. 2.
FIG. 4 is a section view as taken along the line 4—4 of FIG. 2.
FIG. 5 is a detail view of a part of FIG. 2.
FIG. 6 is an end view as taken along the line 6—6 of FIG. 5.

As shown in FIGS. 1 and 2, an extender board connector 10 is provided. Connector 10, which is a two row, right angle style connector, connects a circuit board card (not shown) to a motherboard (not shown) through an extender card (not shown) for routing signals from the motherboard to the extender board for testing the circuit board card.

Connector 10 has a right side portion 12 and a left side portion 14. Right side portion 12 is identical to, but opposite hand to, left side portion 14. Right side portion 12 has a mounting block 16 which is fixedly connected thereto. Right side portion 12 also has a right side fastener 18.

Left side portion 14 also has a left side mounting block 20 with a left side fastener 22. Right side block 16 is identical to, but opposite hand to, left side block 20. Right side fastener 18 is identical to left side fastener 22.

As shown in FIGS. 2, 3, 4, 5 and 6, right side portion 12 has a plain hole 24, and has an integral tab 26 with a hole 28. Right side fastener 18 has a right side pin or key 30 with an axis 31. Pin 30 has an enlarged end portion 32, an octogonal middle portion 34, and a grooved end portion 36. Grooved portion 36 has a ring groove 38. Fastener 18 also has a snap-on retainer ring 40, which is received in ring groove 38. Fastener 18 also has a ring spacer 42, which is disposed next to retainer ring 40. Fastener 18 also has a helical compression spring 44, which is disposed next to ring spacer 42. Pin 30 is adustable to eight different angular positions about axis 31.

Rightr side mounting block 16 has an octogonal or eight-sided slot 46, which receives pin middle portion 34. Mounting block 16 also has a boss 48, which has a tight fit in right side hole 24. Boss 48 has an adhesive layer 50, which is disposed on the radially outer surface thereof.

The material of connector 10 is aluminum. The material of mounting blocks 16, 20 is aluminum alloy. The octogonal slot 46 in mounting block 16 is cut by using an electrical discharge machine. Adhesive layer 50 is an epoxy based adhesive. The material of pin 30 is stainless steel. The material of ring spacer 42 is stainless steel. The material of retaining ring 40 is steel.

In operation, the user determines which keying orientation of pin 30 is desired. The user then compresses spring 44 by pulling on enlarged pin portion 32 or pressing on grooved pin portion 36. Once spring 44 is compressed, pin 30 is free to be rotated to any one of eight desired positions. Once the desired position is achieved, the spring 44 is released and the pin 30 seats in mounting block 16. Pin 30 then cannot rotate due to the octogonal pin portion 34 and the octogonal slot 46.

The advantages of connector 10 and adustable pin 30 are indicated hereafter.

A. Only one extender card which has connector 10 is required for each different circuit board card size.

B. Cost savings are achieved in engineering and field service testing.

C. Pin 30 enables users to procure one extender board with connector 10 for common circuit board cards.

D. Connector 10 allows troubleshooting of circuit board cards while connected to a motherboard.

E. Connector 10 routes signals from the motherboard to the extender board where the circuit board card can be tested.

F. Pin 30 keys the circuit board card within a chassis thereby preventing incorrect installation.

G. Pin 30 which is adjustable, replaces prior art fixed pins.

H. Connector 10 has two adustable pins 30, each pin having eight different postions thereby providing a combination of eight-squared positions or 64 positions.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined follows:

1. A polarizing pin assembly for an extender board connector comprising:

an elongate pin having an enlarged end portion and an octogonal middle portion and a grooved end portion with a ring groove;

a mounting block having an octogonal hole for receiving said octogonal pin middle portion and having a portion to be fixedly connected to an extender board elongate connector hole portion:

a snap-on retaining ring received in said pin ring groove and mounted on the pin:

a ring spacer disposed between the snap-on retaining ring and the mounting block and being mounted on the pin:

a helical compression spring disposed between the ring spacer and the mounting block and being mounted on the pin.

2. An extender board connector for mounting on an extender board for connection to a printed circuit board, comprising:

a first elongate end portion;

a second elongate end portion similar to but opposite hand to the first elongate end portion;

said first and second elongate end portions respectively having first and second mounting block portions with first and second multi-sided holes;

first and second polarizing pin means respectively having first and second adjustable elongate pins respectively rotatable to different orientations and respectively having first and second pin portions;

said first and second pin portions respectively having first and second multi-sided outer surfaces and being respectively received in said first and second multi-sided holes for respectively setting orientations of the elongate pins; and said first and second polarizing pin means respectively having first and second spring means urging said first and second pin multi-sided outer surfaces in respective positions and orientations within said respective first and second multi-sided holes.

3. The connector of claim 2, wherein said first and second spring means have respective first and second helical compression springs and have respective first and second spacer rings and have respective first and second snap-on retainer rings, said retainer rings received in respective first and second grooves in the pins.

4. The connector of claim 2, wherein said first and second multi-sided holes are oclogonal holes; and said first and second multi-sided pin outer surfaces are octogonal surfaces.

5. The connector of claim 2, wherein said first and second mounting block portions respectively have first and second bosses which are press fitted and cemented into respective first and second plain holes respectively disposed in the first and second end portions.

* * * * *